US011619002B2

(12) United States Patent
Bell et al.

(10) Patent No.: US 11,619,002 B2
(45) Date of Patent: Apr. 4, 2023

(54) PRESS FABRIC FOR A TEXTURED PRODUCT

(71) Applicant: Albany International Corp., Rochester, NH (US)

(72) Inventors: James R. Bell, Wynantskill, NY (US); Timothy R. Lamers, Combined Locks, WI (US); Paul A. Nieto, New London, WI (US)

(73) Assignee: Albany International Corp., Rochester, NH (US)

( * ) Notice: Subject to any disclaimer, the term of this patent is extended or adjusted under 35 U.S.C. 154(b) by 167 days.

(21) Appl. No.: 17/015,712

(22) Filed: Sep. 9, 2020

(65) Prior Publication Data

US 2021/0071363 A1 Mar. 11, 2021

Related U.S. Application Data

(60) Provisional application No. 62/898,120, filed on Sep. 10, 2019.

(51) Int. Cl.
*D21F 1/00* (2006.01)
*D21F 7/08* (2006.01)

(52) U.S. Cl.
CPC ..... *D21F 1/0063* (2013.01); *D21F 7/08* (2013.01)

(58) Field of Classification Search
CPC . D21F 1/0063; D21F 7/08; D21F 3/00; D21F 11/006
USPC ..... 162/116, 296, 358.2, 900, 903
See application file for complete search history.

(56) References Cited

U.S. PATENT DOCUMENTS 4,528,239 A * 7/1985 Trokhan ..... D21F 1/0036 442/33
7,144,479 B2 12/2006 Davis et al.
8,216,427 B2 * 7/2012 Klerelid ..... D21F 11/006 162/900
8,454,800 B2 * 6/2013 Mourad ..... D04H 1/44 162/903

FOREIGN PATENT DOCUMENTS

WO WO 2016/049405 A1 3/2016

OTHER PUBLICATIONS

Hexagon Calculator [https://hexagoncalculator.apphb.com], (Year: 2022).*
International Search Report and Written Opinion, prepared by the European Patent Office acting as the International Searching Authority, for International Application PCT/US2020/049795, dated Dec. 3, 2020.

* cited by examiner

*Primary Examiner* — Eric Hug
(74) *Attorney, Agent, or Firm* — McCarter & English, LLP

(57) ABSTRACT

Disclosed is a press fabric and related method to impart a texture to a cellulose product by having macro-voids in a complementary pattern on a sheet-contact side surface of the press fabric.

12 Claims, 7 Drawing Sheets

PRESS FABRIC FOR A TEXTURED PRODUCT

CROSS-REFERENCE TO RELATED APPLICATION

This application claims the benefit of priority of U.S. Provisional Patent Application No. 62/898,120, filed Sep. 10, 2019. The foregoing application is incorporated herein by reference in its entirety.

BACKGROUND

1. Field of the Disclosure

The present invention relates to the papermaking arts. More specifically, the present invention relates to a fabric and related method whereby a water permeable press fabric includes voids in a sheet-contact side surface of the fabric to impart a texture to a paper product.

2. Related Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Press fabrics play a role during the paper manufacturing process. One of their functions, as implied above, is to support and to carry the paper product being manufactured through the press nips. However, press fabrics can also participate in the finishing of the surface of the paper sheet to provide a desired surface texture or characteristic.

Tissue and towel produced with increased bulk and absorption properties can allow lighter basis weight sheets and provide benefits to the consumer. As a result, special tissue and towel making machines have been developed to enable special textured clothing to impart bulk and absorbency into the sheet. These special machines include Through-Air Drying (TAD), New Tissue Technology (NTT), and Advanced Tissue Molding System (ATMOS) machines. These special clothings include TAD fabrics and NTT Belts.

Further, press fabrics also accept the water extracted from the wet paper in the press nip. In order to fulfill this function, there is space in the press fabric. These spaces are empty areas, i.e., without fabric, to receive extracted water. Empty areas in the press fabric have a volume, referred to as "void volume", for the water to go, and the fabric must have adequate permeability to remove water for the useful life of the press fabric. Finally, press fabrics should be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batting of fine, nonwoven fibrous material. The base fabrics may be woven from monofilament, plied monofilament, multifilament or plied multifilament yarns, and may be single-layered, multilayered or laminated. The yarns are typically extruded from any one of several synthetic polymeric resins, such as polyamide and polyester resins, used for this purpose by those of ordinary skill in the paper machine clothing arts.

Woven fabrics take many different forms. For example, they may be woven endless, or flat woven and subsequently rendered into endless form with a seam. Alternatively, they may be produced by a process commonly known as modified endless weaving, wherein the widthwise edges of the base fabric are provided with seaming loops using the machine-direction (MD) yarns thereof. In this process, the MD yarns weave continuously back and forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are seamed together. To facilitate seaming, many current fabrics have seaming loops on the crosswise edges of the two ends of the fabric. The seaming loops themselves are often formed by the MD yarns of the fabric. The seam is typically formed by bringing the two ends of the press fabric together, by interdigitating the seaming loops at the two ends of the fabric, and by directing a so-called pin, or pintle, through the passage defined by the interdigitated seaming loops to lock the two ends of the fabric together.

Further, the woven base fabrics may be laminated by placing one base fabric within the endless loop formed by another, and by needling a staple fiber batting from one or both of the sheet side or machine (roller) side of the base fabrics through both base fabrics to join them to one another. One or both woven base fabrics may be of the on-machine-seamable type.

Other structures can be used as the "base" fabric for a press fabric such as extruded meshes, knitted structures, or other nonwoven products such as foils, films, or spunbonds.

In any event, the press fabrics are in the form of endless loops, or are seamable into such forms, having a specific length, measured longitudinally therearound, and a specific width, measured transversely thereacross.

SUMMARY

A press fabric for imparting a texture to a cellulose product or other fiber or particle based product according to the present disclosure is a papermaker's fabric having a sheet-contact side and a machine side. The press fabric includes macro-voids on the sheet-contact side. The sheet-contact side is adapted to contact the cellulose product and the macro-voids are a topographical feature of the sheet-contact side that is complementary to a desired texture of the cellulose product. The macro-voids have a surface opening area sufficient to enable entry of fibers of the cellulose product.

In various embodiments the macro-voids have a combination of dimensions that include a void volume in the range of 0.04 to 2.5 $mm^3$, a surface opening area in the range of 0.45 to 20 $mm^2$, a depth in the range of 0.3 to 1.5 mm.

In an embodiment, the machine side of the press fabric has voids. The voids may have a void volume less than the void volume of some or all of the void volume of each of the macro-voids.

Alternatively, the voids may have a void volume greater than or equal to the void volume of the macro-voids. In yet another embodiment, the machine side of the press fabric has no voids.

In another embodiment, the cellulose product is a paper product. The paper product may be selected from the group consisting of tissue, towel, and toilet paper.

In some embodiments, the press fabric according to the present disclosure can result in a percent dryness of a cellulose product exiting a press section that is decreased compared to a press fabric without macro-voids.

The disclosure includes a method of imparting a texture to a cellulose product (or other fiber-based or particle product) based product by using a press fabric as disclosed herein on nip rollers in the press section of a papermaking process to compress the product between the nip rollers and the press fabric such that fibers or particles of the product are pressed into void volumes of the macro-voids.

BRIEF DESCRIPTION OF THE DRAWINGS

The accompanying drawings, which are included to provide a further understanding of the invention, are incorporated in and constitute a part of this specification. The drawings presented herein illustrate different embodiments of the invention and together with the description serve to explain the principles of the invention. In the drawings.

DETAILED DESCRIPTION

Figure 1A:
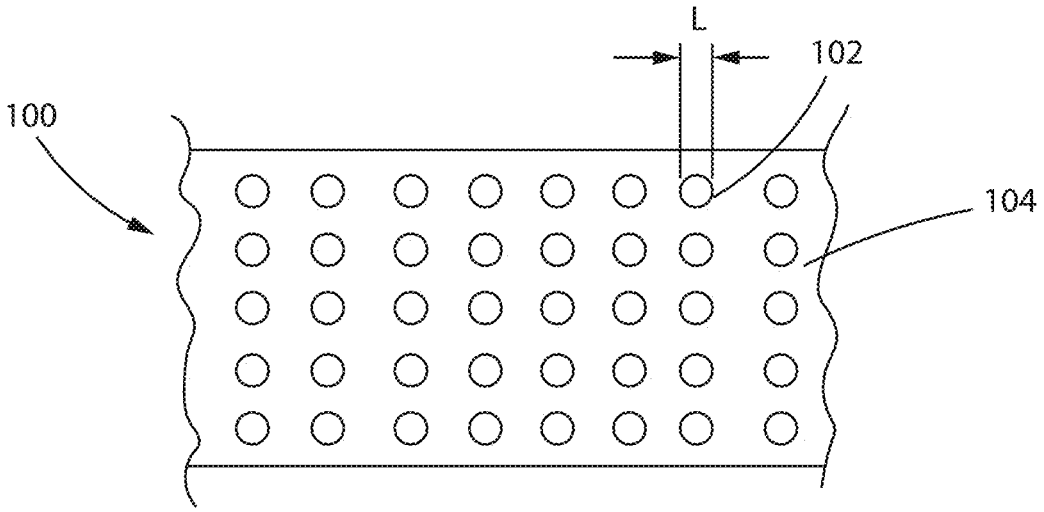
FIGS. 1A-1C illustrate a top view, cross-sectional view, and bottom view of a portion of a press fabric according to the present disclosure.

Terms "comprising" and "comprises" in this disclosure can mean "including" and "includes" or can have the meaning commonly given to the term "comprising" or "comprises" in U.S. Patent Law. Terms "consisting essentially of" or "consists essentially of" if used in the claims have the meaning ascribed to them in U.S. Patent Law. Other aspects of the invention are described in or are obvious from (and within the ambit of the invention) the following disclosure.

The terms "threads", "fibers", "tows", and "yarns" are used interchangeably in the following description. "Threads", "fibers", "tows", and "yarns" as used herein can refer to monofilaments, multifilament yarns, twisted yarns, multifilament tows, textured yarns, braided yarns, coated yarns, bicomponent yarns, as well as yarns made of any material known to those skilled in the art. Yarns can be made of polyamide, fiberglass, cotton, aramid, polyester, metal, polyethylene, and/or other materials that exhibit desired physical, thermal, chemical or other properties.

"Macro-voids" as used herein means a topographical feature of a sheet-contact side surface and is a volume that is below a nominal surface of a press fabric. The term "void volume" means the volume of space in an area of a fabric. For example, "void volume" of a macro-void that extends into a press fabric is the volume of empty space in the macro-void below a nominal surface of the press fabric.

For a better understanding of the invention, its advantages and objects attained by its uses, reference is made to the accompanying descriptive matter in which non-limiting embodiments of the invention are illustrated in the accompanying drawings and in which corresponding components are identified by the same reference numerals.

The present disclosure relates to the fabrics used in the press section, generally known as press fabrics, but it may also find application in the fabrics used in other paper industry processes.

This disclosure relates to texturing an endless or seamed press fabric with the use of a laser or other mechanism to remove batt or other excess fiber in a desired pattern. The press fabric is textured by removing the sheet side batt fiber. The amount of batt fiber removed can be varied to achieve the amount and form of texturing desired. The depth and diameter or width of the removed batt fiber area can be altered. The pattern can also be altered. The pattern can contain any combination of shapes and depths. Shapes include, but are not limited to, circles, lines, dots, waves, drawings, logos, trademarks, or any random or ordered pattern desired.

The disclosed technique is advantageous because the technique allows an existing conventional tissue or towel machine to be used in its current configuration to make higher bulk grades that previously required machine rebuilds or a new machine installation. The ability to use specific and custom patterns is also advantageous. For example, some tissues, paper towels, and toilet papers may have surface texture for purposes including ornamentation, bulk, or enhanced absorbency, or some other desired characteristic.

Figure 1B:
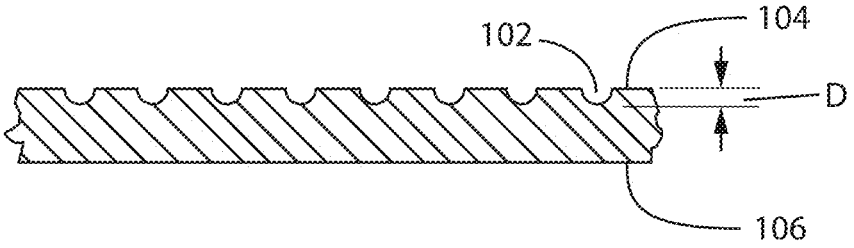
Figure 1C:
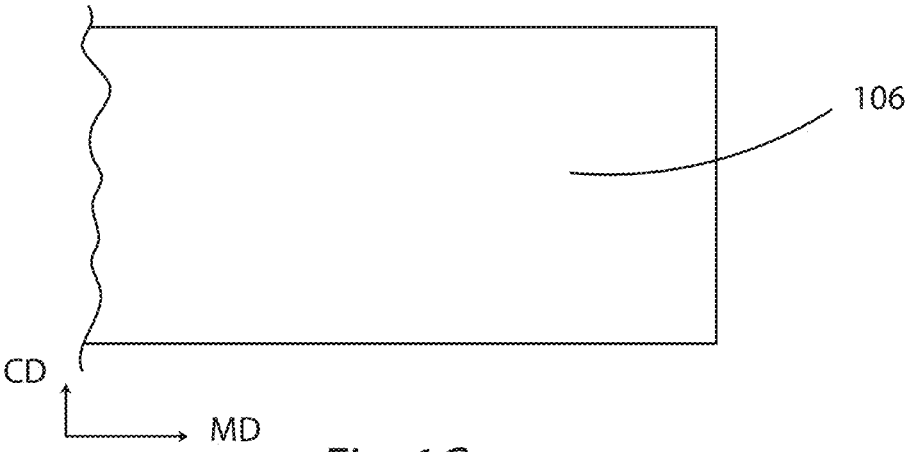

FIGS. 1A-1C illustrate a top view, cross-sectional view, and bottom view of a portion of a press fabric 100 according to the present disclosure. The press fabric has a sheet-contact-side surface 104 and a machine side surface 106. The press fabric is often water permeable to enable passage of water from a cellulose product through the fabric as the product passes through the press section. However, some areas of the press fabric can be impermeable to water. Faceside or sheet-contact side surface 104 includes macro-voids 102. The sheet-contact surface is adapted to contact a cellulose product and impart a texture to that product as a result of the macro-voids and as will be described later. The opposite side of the belt is the machine or roller side 106, which is adapted to contact nip rollers of the press section. The machine side can have features distinguishable from the sheet-contact side to provide for such characteristics, for example, as adhesion to the nip rollers, water removal, wear resistance, etc.

Macro-voids 102 are illustrated as an array of circular voids—a volume where press fabric is removed or missing—for convenience. The shape of the macro-voids is not limited to a circular shape or to an ordered array. Macro-voids 102 can be a negative (complementary) image of the texture desired for the cellulose product. Macro-voids below a nominal top surface 104 of a press fabric are described herein. Designs of the macro-voids include, for example, circular/hemispherical, square/pyramidal, rectangular/cuboid, hexagonal, elliptical, annular/semi-toroidal, and grooved. Other void array patterns may include, for instance, hexagonal, pseudo random, triangular, and linear/spiral (for example, grooved). Moreover, the macro-voids need not be in an ordered array and can have differing void volumes dependent on the desired texture imparted to the cellulose product. Macro-voids 102 may have a breadth L (surface opening area) and a depth D sufficient to enable fibers of a cellulose product to enter into the void volume. Macro-voids can have a void volume in the range of approximately 0.04 to 2.5 $mm^3$, a surface opening area in the range of 0.45 to 20 $mm^2$, and a depth in the range of 0.3 to 1.5 mm.

Press fabric 100 may be water permeable and comprised of more than one layer (not shown). For example, sheet-contact side surface with macro-voids 102 may be one layer attached to a base fabric later. Attachment of layers may be accomplished by any method known to those of ordinary skill in the art and includes hydroentangling layers and laminating layers. Machine side 106 of the press fabric may have no voids, voids having void volumes less than that of the macro-voids, or voids with void volumes equal to or greater than the macro-voids 102 on the sheet-contact side of the press fabric.

The macro-voids can be produced by any method known to those of ordinary skill in the art and includes laser etching, chemical etching, photo etching, drilling, pressing, and such. Laser etching can produce definition of the geometry of the macro-voids by control of laser parameters. However, the present disclosure is not limited by the method of producing the macro-voids.

Figure 2:
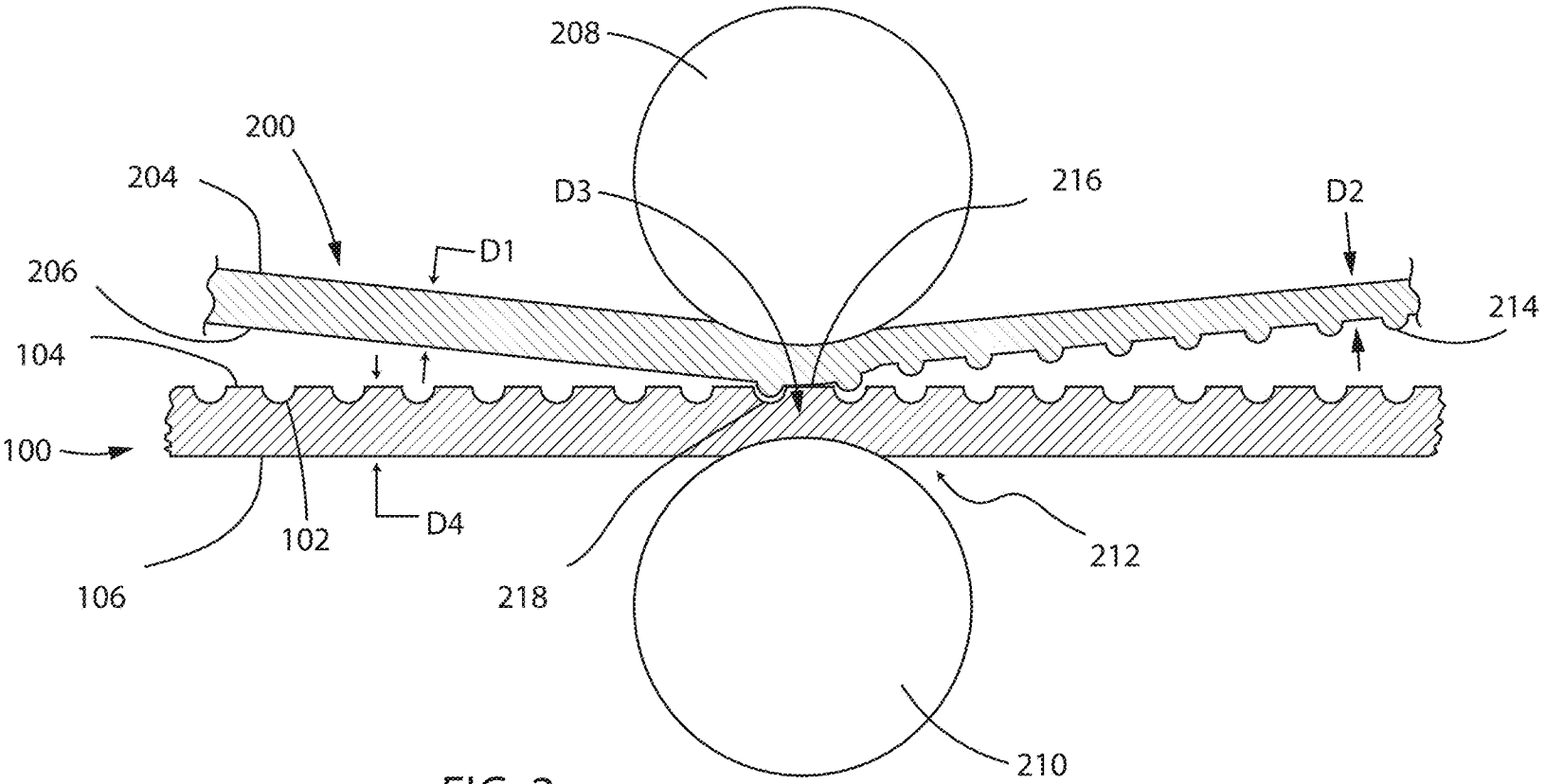
FIG. 2 illustrates a press section employing a press fabric of the present disclosure to impart a texture to a cellulose product.

FIG. 2 illustrates press fabric 100 as may be used to impart a texture to a cellulose product 200, such as a paper sheet. The texture may be imparted during the press section and, in particular, when the belt and cellulose product are pressed together between nip rollers during dewatering of the cellulose product. Press fabric 100 and cellulose product 200 are shown separated for clarity and may be in contact during the texture imparting process.

Cellulose product 200 can be conveyed by press fabric 100 to a nip section 212 between nip rollers 208, 210. The distance D3 between nip rollers 208, 210 is less than the sum of the width D1 of the cellulose product and the width D4 of the press fabric entering the nip section 212. As such, the cellulose product is compressed against the press fabric. The cellulose product will be compressed a greater amount in areas not having macro-voids 216 than in areas of the macro-voids 218 due to a depth of the void volume in the press fabric. Some of the fibers of the cellulose product can enter into macro-voids 102 of the press fabric. Compression between the nip rollers can result in compaction of the cellulose fibers and decrease width of the cellulose product to width D2. However, the lesser compaction and fiber entry in the macro-void areas can result in a surface texture 214.

The cellulose product may be a slurry of cellulose fibers and water entering the press section where the product is compressed and dewatered. Dewatering results from compression of the cellulose slurry between nip rollers and the press fabric in the press section.

As discussed above, a press fabric having macro-voids on the sheet-contact side surface 104 that contacts the cellulose slurry surface 206 applies less pressure in areas of the press fabric having macro-voids 218 than in areas of the press fabric not having macro-voids 216. Accordingly, there may be less dewatering using a press fabric having macro-voids according to the present disclosure than when using a comparable press fabric without the voids.

EXPERIMENTAL RESULTS

Less dewatering using a press fabric with macro-voids was tested by comparing dryness of cellulose paper using a press fabric with macro-voids with paper dryness using a press fabric without macro-voids in a press section. The paper dryness trials were run at differing paper speeds.

Figure 3:
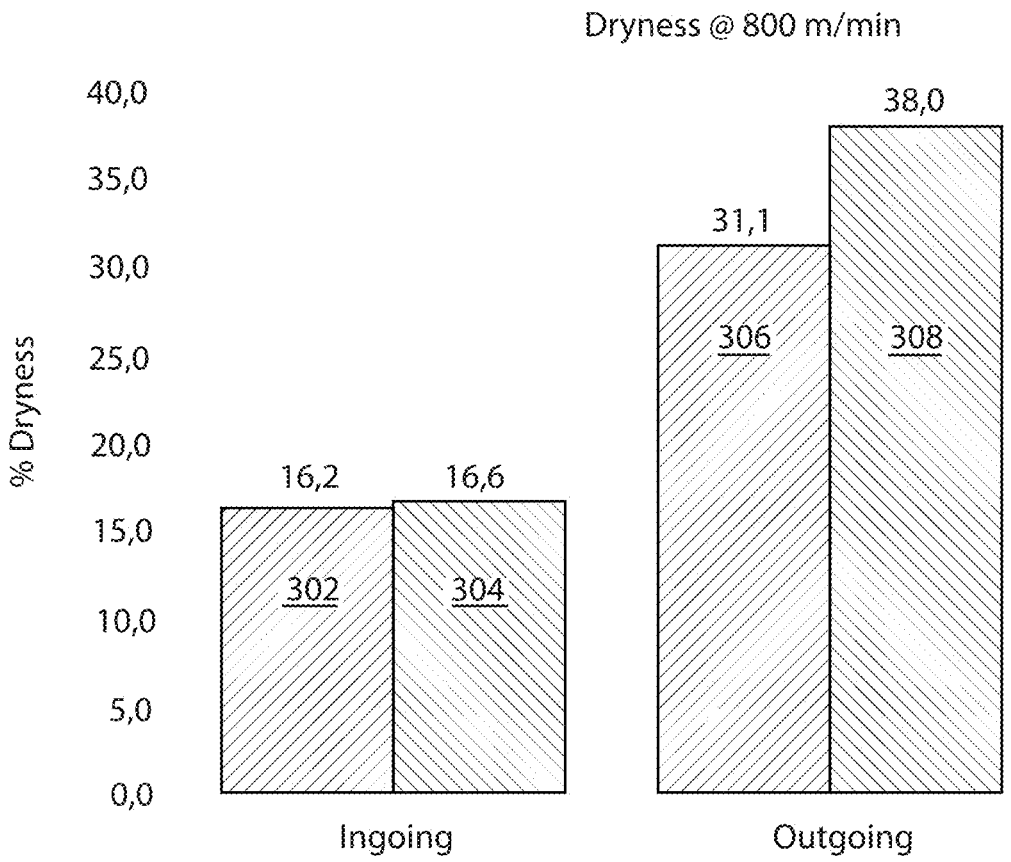
FIG. 3 is a graphical representation of the dewatering of a cellulose product produced with a press fabric of the present disclosure compared with a prior art press fabric at a speed of 800 meters/minute.
Figure 4:
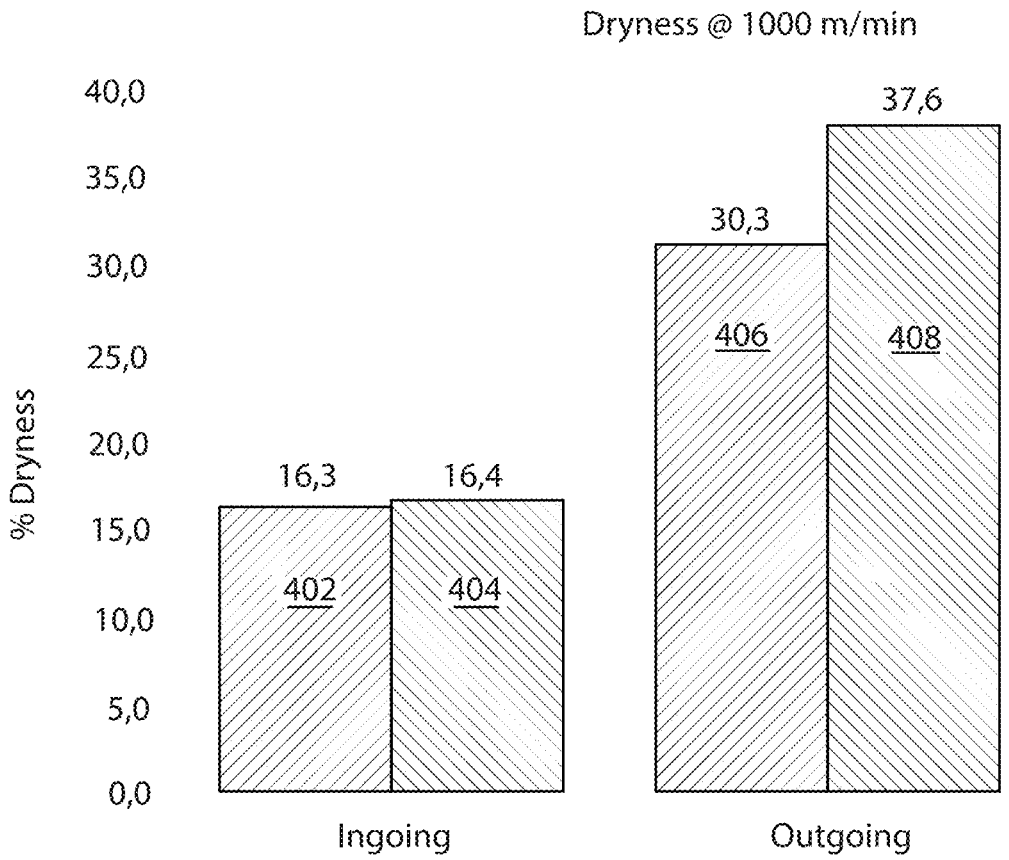
FIG. 4 is a graphical representation of the dewatering of a cellulose product produced with a press fabric of the present disclosure compared with a prior art press fabric at a speed of 1000 meters/minute.

FIGS. 3 and 4 are graphical results of paper dryness ingoing and outgoing from the press section at a paper speed of 800 meters/minute (FIG. 3) and 1000 meters/minute (FIG. 4) as discussed in more detail below. Percent dryness, m, is calculated according to the formula:

$$m = 100 * \left( \frac{\text{mass of cellulose product}}{\text{mass of water} + \text{mass of cellulose product}} \right) \quad \text{Eqn. 1}$$

Example 1

Paper was processed using press fabric having a textured sheet side contacting the paper through the press section under the following conditions:

| | |
|---|---|
| Paper Grammage | 27 grams/$m^2$ (Tissue Pulp) |
| Linear Load | 30 kN/m~2.3 MPa |
| Speed | 800 m/min |
| Uhle box vacuum | −20 kPa |
| Showers | 2 liter/min uhle box lubrication |

FIG. 3 shows a comparison of the percent dryness for a cellulose product (sheet) at a speed of 800 meters/minute ingoing (entering) and outgoing (exiting) a press section having a press fabric with macro-voids on the sheet side 302, 306 and a press fabric without macro-voids on the sheet side 304, 308. The percent dryness of the cellulose product ingoing (entering) the press section with macro-voids 302 is 16.2% and the cellulose product entering the press section without macro-voids 304 is 16.6%. The ingoing values of percent dryness are close in value to one another. That is, the cellulose products are about the same percent dryness entering the press section.

However, for cellulose product moving at 800 meters/minute, the percent dryness of the cellulose product outgoing (exiting) the press section having a press fabric with macro-voids on the paper contact surface 306 is 31.1%, which is substantially less dry than the 38.0% dryness of the cellulose product outgoing (exiting) the press section having a press fabric without macro-voids on the paper contact surface 308, In other words, the cellulose product has less dewatering from the press fabric with macro-voids as compared to the press fabric without macro-voids.

Example 2

Paper was processed using press fabric having a textured sheet side contacting the paper through the press section under the following conditions:

| | |
|---|---|
| Paper Grammage | 27 grams/m$^2$ (Tissue Pulp) |
| Linear Load | 30 kN/m~2.3 MPa |
| Speed | 1000 m/min |
| Uhle box vacuum | −20 kPa |
| Showers | 2 liter/min uhle box lubrication |

FIG. 4 shows a comparison of the percent dryness for a cellulose product (sheet) at a speed of 1000 meters/minute ingoing (entering) and outgoing (exiting) a press section having a press fabric with macro-voids on the sheet side 402, 406 and a press fabric without macro-voids on the sheet side 404, 408. The percent dryness of the cellulose product ingoing (entering) the press section with macro-voids 402 is 16.3% and the cellulose product entering the press section without macro-voids 404 is 16.4%. The ingoing values of percent dryness are close in value to one another. That is the cellulose products are about the same percent dryness entering the press section.

However, for cellulose product moving at 1000 meters/minute, the percent dryness of the cellulose product outgoing (exiting) the press section having a press fabric with macro-voids on the paper contact surface 406 is 30.3%, which is substantially less dry than the 37.6 percent dryness of the cellulose product outgoing (exiting) the press section having a press fabric without macro-voids on the paper contact surface 408. In other words, the cellulose product has less dewatering from the press fabric with macro-voids as compared to the press fabric without macro-voids.

In summary, the experimental results confirm that macro-voids on a sheet-contact (or face) side of a press fabric results in less dewatering in a press section than with a press fabric without macro-voids on the sheet-contact side of the press fabric.

Example 3

Figure 5B:
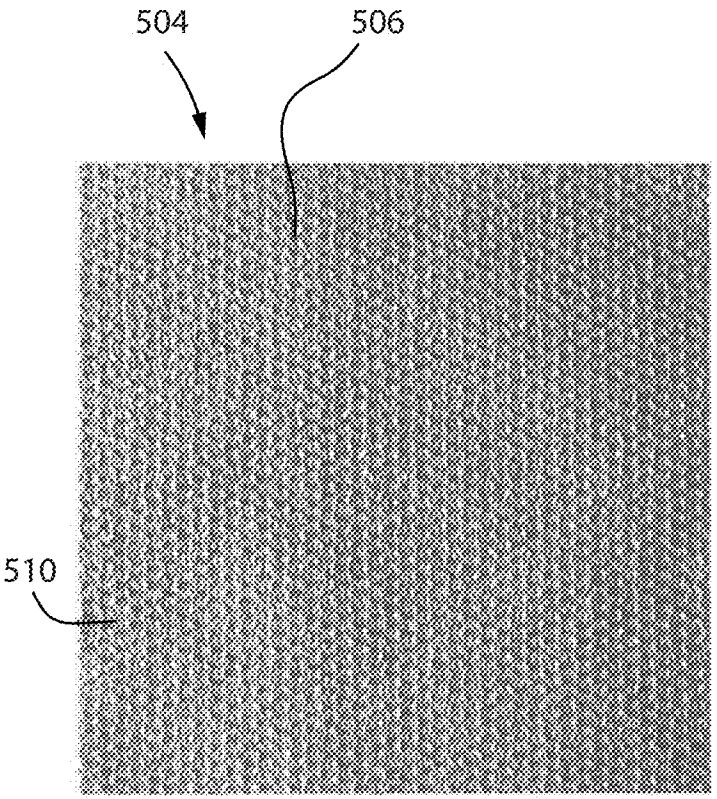
FIGS. 5A-5B illustrate a cellulose product resulting from a press section having a prior art press fabric (FIG. 5A) and a cellulose product having a texture resulting from a press section having a press fabric of the present disclosure (FIG. 5B).
Figure 5A:
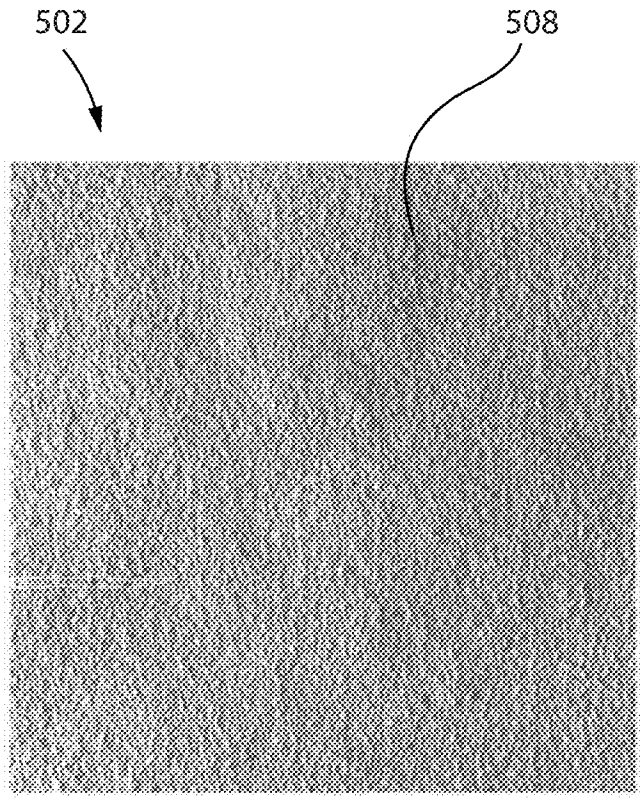

FIGS. 5A and 5B is an illustration of a portion of a resultant cellulose product produced with a press section having a press fabric without macro-voids on the sheet-contact surface 502 and a cellulose product produced with a press section having a press fabric with macro-voids on the sheet-contact surface 504. Cellulose product 502 has a surface 508 with a smooth or random texture of compressed cellulose fibers. In contrast, cellulose product 504 produced with a press fabric such as illustrated in FIGS. 1A-1C has a surface 506 with a textured surface having raised portions 510, which are a negative image of the press fabric. That is, depressed areas of the press fabric result in raised portions of the cellulose product.

Figure 6:
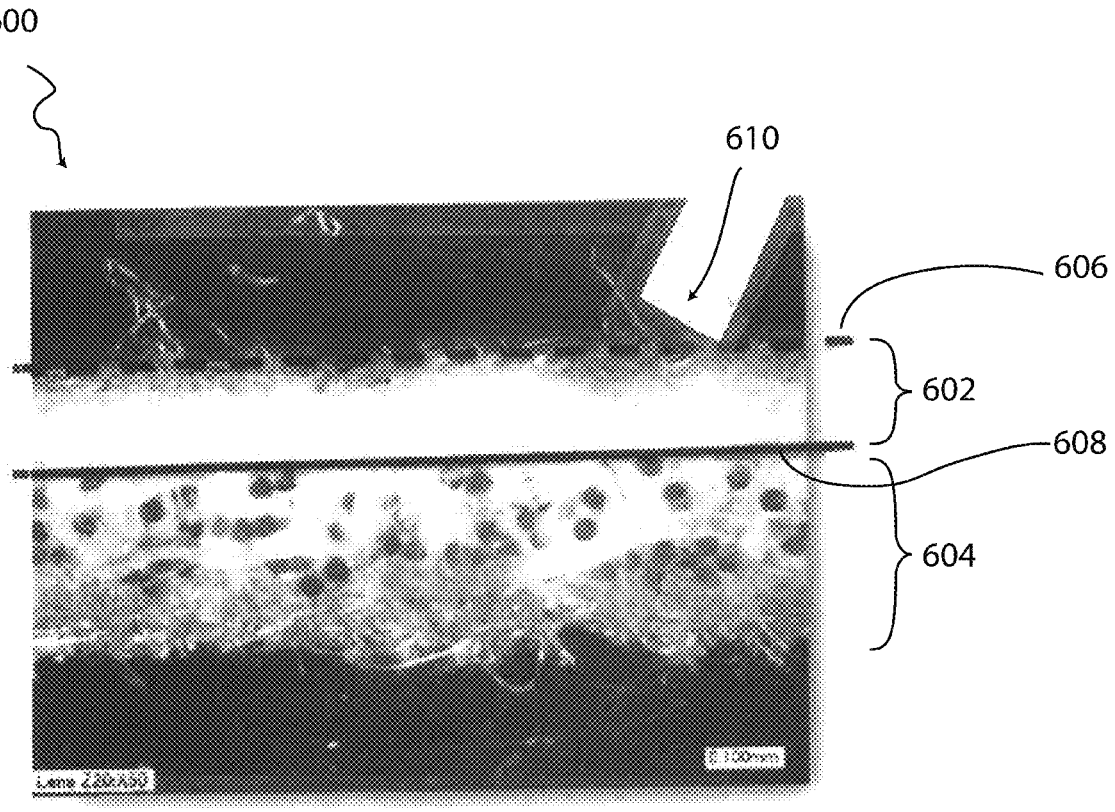
FIG. 6 illustrates a cross-sectional view of a press fabric according to the present disclosure having batt material on a sheet side.

FIG. 6 illustrates a cross-sectional view of one embodiment of a press fabric 600. The press fabric can include a support layer 604 with a batt layer 602 disposed thereon on the sheet side 610 of the press fabric. Press fabric texturing is achieved by removing selected portions of sheet side batt in a pattern between the dashed line 606 and the solid line 608, provided for explanation purposes.

Figure 7:
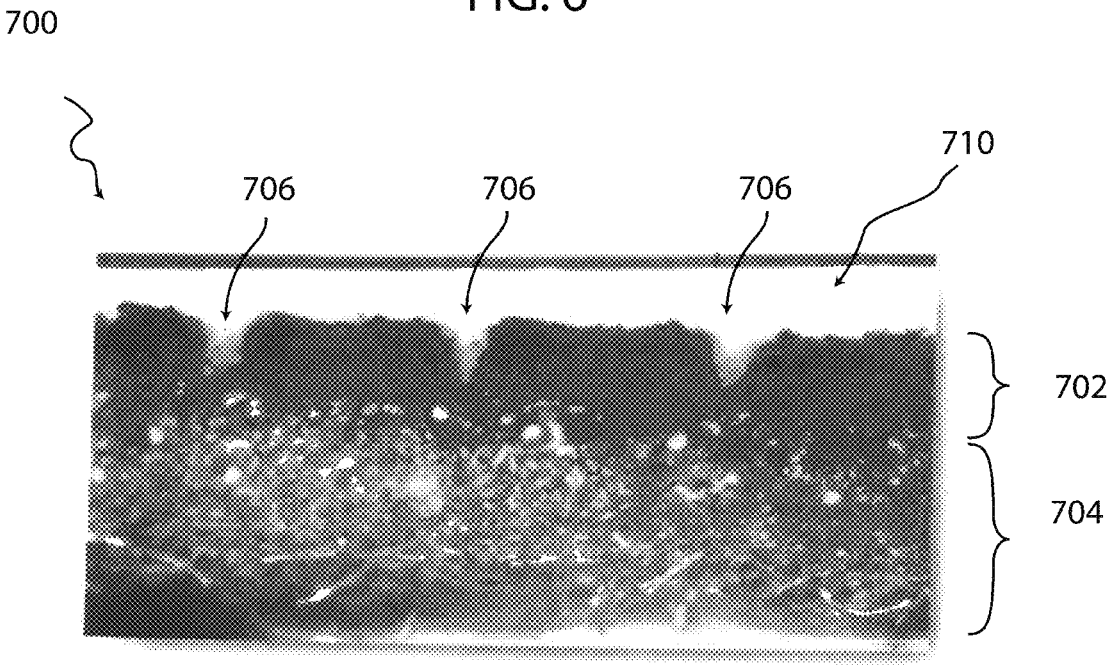
FIG. 7 illustrates a cross-sectional view of a textured press fabric according to the present disclosure.

FIG. 7 illustrates a cross-sectional view of a press fabric 700 having portions 706 of a batt layer 702 removed on a sheet side 710. The batt layer is disposed on a support layer 704. The removed portions 706 can impart a texture to a cellulose product produced using the press fabric 700 in the press section.

Figure 8:
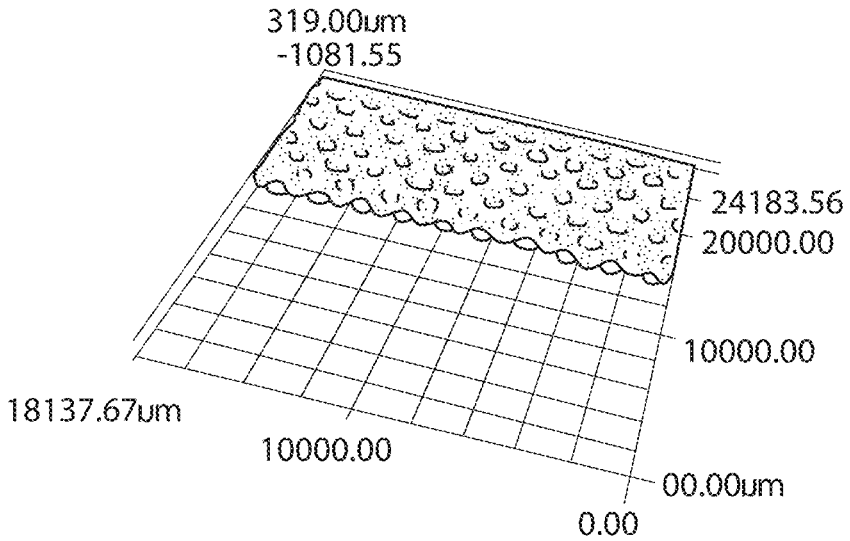
FIG. 8 illustrates a representation of a three-dimensional profile of a textured sheet side surface according to the present disclosure.

FIG. 8 illustrates a representation of a textured surface of a press fabric of the present disclosure having a three-dimensional (3D) profile. Note that the surface profile could contain any combination of shapes and depths. Shapes include, but are not limited to, circles, lines, dots, waves, drawings, logos, trademarks, or any random or ordered pattern desired.

Figure 9:
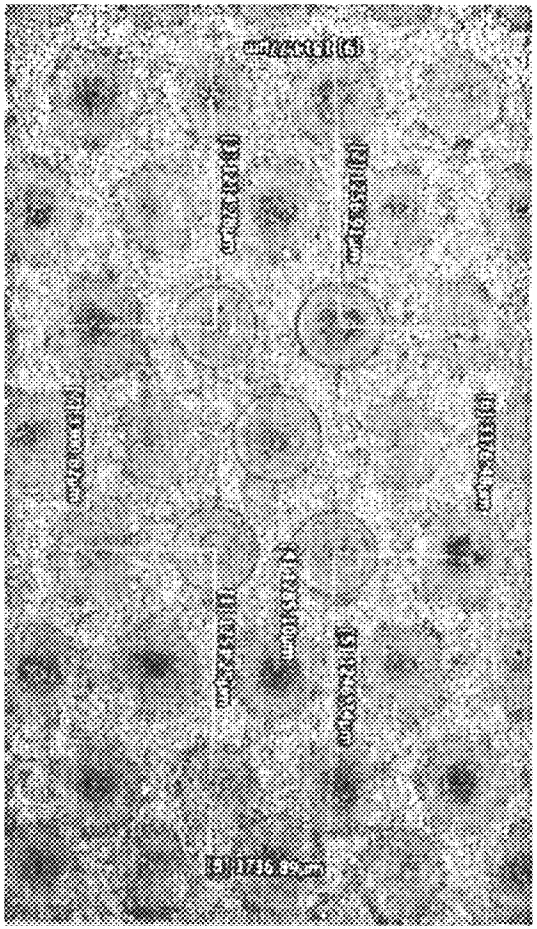
FIG. 9 is a photographic image of an embodiment of a textured surface exiting a press section having a press fabric according to the present disclosure.

FIG. 9 is a photographic image of a textured sheet side surface of a press fabric of the present disclosure as seen through a microscope. As discussed herein above, the surface profile could contain any combination of shapes and depths. Shapes include, but are not limited to, circles, lines, dots, waves, drawings, logos, trademarks, or any random or ordered pattern desired.

Other embodiments are within the scope of the following claims.

The invention claimed is:

1. A press fabric for imparting a texture to a cellulose product, comprising:

a papermaker's fabric having a sheet-contact side and a machine side, wherein the papermaker's fabric comprises macro-voids on the sheet-contact side, a depth of the macro-voids being less than a width of the papermaker's fabric, wherein the sheet-contact side is adapted to contact the cellulose product and the macro-voids are a topographical feature of the sheet-contact side that is complementary to a desired texture of the cellulose product, and wherein the percent dryness of the cellulose product exiting a press section is decreased compared to a press fabric without macro-voids.

2. The press fabric according to claim 1, wherein the macro-voids have a surface opening area sufficient to enable entry of fibers of the cellulose product.

3. The press fabric according to claim 1, wherein the macro-voids have a surface opening area in the range of 0.45 to 20 mm$^2$.

4. The press fabric according to claim 1, wherein the macro-voids have a void volume in the range of 0.04 to 2.5 mm$^3$.

5. The press fabric according to claim 1, wherein the macro-voids have a depth in the range of 0.3 to 1.5 mm.

6. The press fabric according to claim 1, wherein the machine side has voids.

7. The press fabric according to claim 6, wherein the machine-side voids have a void volume less than the void volume of some or all of the void volume of the macro-voids.

8. The press fabric according to claim 6, wherein the machine-side voids have a void volume greater than or equal to the void volume of the macro-voids.

9. The press fabric according to claim 1, wherein the machine side has no voids.

10. The press fabric according to claim 1, wherein the cellulose product is a paper product.

11. The press fabric according to claim 10, wherein the paper product is selected from the group consisting of: tissue, towel, and toilet paper.

12. A method of imparting a texture to a cellulose product, comprising:

acquiring a press fabric according to claim 1;

using the press fabric on nip rollers in the press section of a papermaking process; and compressing the cellulose product between the nip rollers and the press fabric, wherein fibers of the cellulose product are urged into void volumes of the macro-voids.

* * * * *